US005498343A

United States Patent [19]

Farrell et al.

[11] Patent Number: 5,498,343

[45] Date of Patent: Mar. 12, 1996

[54] BINARY ACTIVE TOILET BAR COMPOSITION COMPRISING SOAP AND ALDOBIONAMIDES

[75] Inventors: Terence Farrell, Guttenburg, N.J.; Michael Massaro, Congers, N.Y.

[73] Assignee: Lever Brothers Company, Division of Conopco, Inc., New York, N.Y.

[21] Appl. No.: 410,554

[22] Filed: Mar. 24, 1995

Related U.S. Application Data

[63] Continuation of Ser. No. 260,142, Jun. 15, 1994, abandoned.

[51] Int. Cl.[6] ..... C11D 9/30; C11D 3/26; C11D 7/32

[52] U.S. Cl. ..... 252/108; 252/117; 252/542; 252/548; 252/174.17; 252/DIG. 16

[58] Field of Search ..... 252/108, 117, 252/542, 548, DIG. 16, 174.17

[56] References Cited

U.S. PATENT DOCUMENTS

| | | | |
|---|---|---|---|
| 2,752,334 | 6/1956 | Walton | 260/211 |
| 5,037,973 | 8/1991 | Meinetsberger | 536/53 |
| 5,296,588 | 3/1994 | Au et al. | 536/1.11 |

FOREIGN PATENT DOCUMENTS

| | | | |
|---|---|---|---|
| 0550281 | 7/1993 | European Pat. Off. | A61K 7/50 |

*Primary Examiner*—E. Rollins Cross
*Assistant Examiner*—Patricia Hailey
*Attorney, Agent, or Firm*—Ronald A. Koatz

[57] ABSTRACT

The present invention relates to the toilet bar compositions comprising, as sole active system, 50–95% of active system soap and 5 to 50% of active system aldobionamide, said active system comprising about 75% to 95% by wt. of the toilet bar composition.

7 Claims, No Drawings

BINARY ACTIVE TOILET BAR COMPOSITION COMPRISING SOAP AND ALDOBIONAMIDES

This is a continuation application of Ser. No. 08/260,142, filed Jun. 15, 1994, now abandoned.

FIELD OF THE INVENTION

The present invention relates to binary active compositions comprising soap as one active and aldobionamides as the second active. These bars have been found to provide superior lather and to be milder relative to compositions comprising soap and a different nonionic surfactant.

BACKGROUND OF THE INVENTION

The use of aldobionamides in toilet bar compositions is known. U.S. Ser. No. 981,737 to Au et al., for example, assigned to the same assignee as the present invention, provides toilet bar compositions comprising aldobionamides. This application is hereby incorporated by reference into the subject application.

U.S. Ser. No. 981,737 to Au et al. discloses that the compositions of that invention can contain 30–95% soap and "other" surfactants. There is no teaching or suggestion that the soap and aldobionamide be used in a solely binary active system. Moreover, there is no teaching or recognition that in an all soap/nonionic binary active system, aldobionamides provide superior benefits relative to the use of other nonionics.

SUMMARY OF THE INVENTION

Unexpectedly, applicants have now found that, in a soap/nonionic binary active toilet bar composition, aldobionamide nonionic surfactants provide superior properties (i.e., lather in line with pure soap bars and greater mildness) relative to the combination of soap and other nonionics.

DETAILED DESCRIPTION OF THE INVENTION

The present invention relates to toilet bar compositions comprising, as detergent active system, soap in combination with aldobionamides (e.g., lactobionamides).

More specifically, applicants have found that when soaps are used in combination with aldobionamides as a nonionic surfactant in a binary active system, the aldobionamide has advantages not seen compared to when soap is used in combination with a different nonionic surfactant.

The soap/aldobionamide active system of the invention generally comprises 75% to 95% by wt. of the toilet bar compositions wherein the ratio of soap to aldobionamide may range from 20:1 to 1:20, preferably 10:1 to 1:5, more preferably 5:1 to 1:1.

One component of the binary active detergent active system of compositions of the invention are fatty acid soaps.

Fatty acid soaps are typically alkali metal or alkanol ammonium salts of aliphatic alkane or alkene monocarboxylic acids. Sodium, potassium, mono-, di- and tri-ethanol ammonium cations, or combinations thereof, are suitable for purposes of the invention. The soaps are well known alkali metal salts of natural or synthetic aliphatic (alkanoic or alkenoic) acids having about 8 to 22 carbons, preferably 12 to about 18 carbons. They may be described as alkali metal carboxylates of acrylic hydrocarbons having about 12 to 22 carbons.

Examples of soap which may be used may be found in U.S. Pat. No. 4,695,395 to Caswell et al. and U.S. Pat. No. 4,260,507 (Barrett), both of which are incorporated herein by reference.

Soap will generally comprise 50–95%, preferably 55% to 90%, most preferably 60% to 85% of the binary active system.

The second active of the binary active detergent active systems is the aldobionamide.

Aldobionamides are defined as the amide of an aldobionic acid (or aldobionolactone) and an aldobionic acid is a sugar substance (e.g., any cyclic sugar comprising at least two saccharide units) wherein the aldehyde group (generally found at the $C_1$ position of the sugar) has been replaced by a carboxylic acid, which upon drying cyclizes do an aldonolactone.

An aldobionamide may be based on compounds comprising two saccharide units (e.g., lactobionamides or maltobionamides from the aldobionamide bonds), or they may be based on compounds comprising more than two saccharide units, as long as the terminal sugar in the polysaccharide has an aldehyde group. By definition an aldobionamide must have at least two saccharide units and cannot be linear. Disaccharide compounds such as lactobianomides or maltobionamides are preferred compounds. Other examples of aldobionamides (disaccharides) which may be used include cellobionamides, melibionamides and gentiobionamides.

A specific example of an aldobionamide which may be used for purposes of the invention is the disaccharide lactobionamide set forth below:

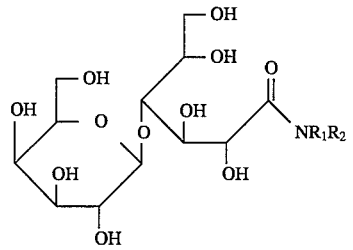

wherein $R_1$ and $R_2$ are the same or different and are selected from the group consisting of hydrogen; an aliphatic hydrocarbon radical (e.g., alkyl groups and alkene groups which groups may contain heteroatoms such as N, O or S or alkoxylated alkyl chains such as ethoxylated or propoxylated alkyl groups), preferably an alkyl group having 8 to 24, preferably 10 to 18 carbons; an aromatic radical (including substituted or unsubstituted aryl groups and arenes); a cycloaliphatic radical; an amino acid ester, ether amines and mixtures thereof, except that $R_1$ and $R_2$ cannot be hydrogen at the same time.

Suitable aliphatic hydrocarbon radicals include saturated and unsaturated radicals including but not limited to methyl, ethyl, amyl, hexyl, heptyl, nonyl, decyl, undecyl, dodecyl, tridecyl, tetradecyl, pentadecyl, hexadecyl, heptadecyl and octadecyl, and allyl, undecenyl, oleyl, linoleyl, linolenyl, propenyl, and heptenyl.

Aromatic radicals are exemplified, for example, by benzyl.

Suitable mixed aliphatic aromatic radicals are exemplified by benzyl, phenyl ethyl, and vinyl benzyl, Cycloaliphatic radicals are exemplified by cyclopentyl and cyclohexyl.

The aldobionamide generally will comprise 5 to 50%, preferably 10 to 45%, most preferably 15% to 40% of the binary active system.

As mentioned above, the detergent active system may itself comprise 75% to 95% by wt. of the toilet bar compositions.

While aldobionamides have previously been known to be used in combination with fatty acid soaps (as in U.S. Ser. No. 981,737), they have never been taught for use as the sole nonionic surfactant in combination with fatty acid soap. While not wishing to be bound by theory, this may be because the combination of soap and nonionics generally produces compositions which lather less well than soap alone and which still are harsh, especially at values above 1:1 soap to nonionic.

Unexpectedly, applicants have discovered that, when the nonionic surfactant is an aldobionamide, lather volumes are far superior than lather volume when soap is used with other anionics and, further, that the combination of soap and aldobionamides is milder than the combination of soap with other nonionics.

In addition to the soap/aldonamide active system of the invention, the compositions must also comprise a minimum of about 5% by wt. water, preferably 5–20% by wt. water.

In addition, among the optional ingredients which may be used are included moisturizers such as glycerin, propylene glycol, sorbitol, polyethylene glycol, ethoxylated or methoxylated ether of methyl glucose etc; water-soluble polymers such as collagens, modified cellulases (such as Polymer JR®), guar gums and polyacrylates; sequestering agents such as citrate; and emollients such as silicones or mineral oil.

In addition other ingredients, such as germicides, perfumes, colorants, pigments, suds-boosting salts and anti-mushing agents may also be added.

Unless stated otherwise,all percentages mentioned in the specification and claims are percentages by weight.

The following examples are intended to further illustrate the example. The examples are not intended to cover every embodiment of the invention and are not intended to be limiting in any way.

EXAMPLE 1

It is generally believed that surfactants become irritants because they penetrate the stratum corneum and then react with the inner cells of the epidermis.

Traditionally, the study of percutaneous absorption has focused on measuring the diffusion of chemicals through the stratum corneum.

We have obtained information on mildness potentials of sodium(alkyl glycosid)uronates through the use of in vitro tests which have been demonstrated to correlate well with in vivo tests.

Gotte in Proc. Int. Cong. Surface Active Subs., 4th Brussels (1964), 3, 83–90 and Schwinger in Kolloid-Z.Z-.Poly., (1969), 233, 898 have shown that a surfactant's ability to solubilize zein, an insoluble maize protein, correlates well with surfactant irritation potential.

More specifically, the greater the zein solubilization, the greater the irritation potential of a surfactant.

In order to test irritancy potential, a 1% solution of surfactant (30 mls) was added to 1.5 g zein and stirred at room temperature for one hour. Residual zein was collected and dried to constant weight. Differences between starting and residual weights were used to calculate % zein dissolved.

Using the zein solubilization assay, the results below were obtained.

Specifically, percent zein dissolution at various ratios of soap to nonionic (either lactobionamide or Brij 68 (which is a cetearyl ether having 20 oxyethylene groups)) was measured and results are set forth as follows:

| Ratio | % zein dissolution using SOAP/BRIJ 68 | % zein dissolution using SOAP/LACTOBIONAMIDE |
|---|---|---|
| 9:1 | 100 | 99 |
| 8:2 | 97 | 88 |
| 7:3 | 88 | 80 |
| 6:4 | 78 | 66 |
| 5:5 | 69 | 65 |
| 4:6 | 56 | 51 |

As noted, the % zein dissolution was lower using the soap/aldobionamide system in every case. This is a clear indication of the unexpected, enhanced mildness observed using lactobionamide in a binary active system rather than other nonionics.

EXAMPLE 2

Lather Volume

Lather volumes were determined using the standard personal wash research method as follows. The bar is taken in gloved hands, held under running water at 95° F. and turned ten times to generate lather. The lather is then pulled from both hands and gathered under a large inverted cone which tapers into a graduated cylinder. The cone is then submerged into a basin of water forcing the lather into the cylinder, at which time the volume of lather generated can be measured.

Using the method outlined above the lather volumes are done in groups of 5, two of which are control bars and results set forth below.

| | Set #1 | | | | |
|---|---|---|---|---|---|
| | Soap:Brij 68 9:1 | Soap:Brij 68 7:3 | Soap:Lacto 9:1 | Dove | Lux |
| Volume (ml) | 49 | 48 | 70 | 91 | 72 |
| Std. Dev. | 8 | 8 | 7 | 12 | 6 |

| | Set #2 | | | | |
|---|---|---|---|---|---|
| | Soap:Lacto 8:2 | Soap:Lacto 7:3 | Soap:Lacto 6:4 | Dove | Lux |
| Volume (ml) | 91 | 69 | 70 | 100 | 63 |
| Std. Dev. | 7 | 7 | 5 | 11 | 15 |

As clearly seen from the data above, the soap:lactobionamide lather volumes were far superior to those of soap:Brig 68 bars. In direct comparison, a 9:1 soap:lacto bar had volume of 70 ml (first set of five) while 9:1 ratio of soap:Brij 68 was 49 ml. This was directly comparable to pure soap Lux® bar.

In the second set, it could again be seen that soap:lacto provided high lather volumes superior to Lux® in all cases in that set.

Unexpectedly, applicants have found a nonionic surfactant which can be used in combination with soap in a binary active system and which does not significantly deplete lather volume.

We claim:

1. A toilet bar composition comprising:

(1) 75% to 95% by weight of a binary active system; and (2) 5% to 20% by weight water; wherein said binary active system consists of (a) 55% to 95% soap; and (b) 5% to 45% aldobionamide.

2. A composition according to claim 1, wherein the aldobionamide is lactobionamide.

3. A composition according to claim 1, which additionally comprises ingredients selected from the group consisting of moisturizers, water soluble polymers, sequestering agents, emollients, germicides, perfumes, colorants, pigments, sud-boosting salts, anti-mushing agents and mixtures thereof.

4. A composition according to claim 1, wherein the binary active system consists of 55 to 90% soap.

5. A composition according to claim 1, wherein the binary active system consists of 60 to 85% soap.

6. A composition according to claim 1, wherein the binary active system consists of 10 to 45% aldobionamide.

7. A composition according to claim 1, wherein the binary active system consists of 15 to 40% aldobionamide.

* * * * *